United States Patent [19]

Smits

[11] 4,077,144

[45] Mar. 7, 1978

[54] TRAILER WARNING PANEL ASSEMBLY

[75] Inventor: Willem C. Smits, Elgin, Ill.

[73] Assignee: Beatrice Foods, Chicago, Ill.

[21] Appl. No.: 511,924

[22] Filed: Oct. 3, 1974

[51] Int. Cl.[2] ..... G09F 21/04

[52] U.S. Cl. ..... 40/590; 40/610; 340/87

[58] Field of Search ..... 40/129 R, 129 C, 125 H, 40/125 N, 125 R, 33, 145 R; 340/87, 84, 114 B, 129, 133, 107

[56] References Cited

U.S. PATENT DOCUMENTS

| | | | |
|---|---|---|---|
| 3,579,880 | 5/1971 | Murphy | 40/145 R X |
| 3,609,898 | 10/1971 | Brown | 40/125 H |
| 3,622,980 | 11/1971 | Elledge | 40/129 R X |
| 3,702,033 | 11/1972 | Coleman | 40/129 R |
| 3,852,902 | 12/1974 | Wheeler | 40/129 R |

*Primary Examiner*—John F. Pitrelli

*Attorney, Agent, or Firm*—Dominik, Knechtel, Godula & Demeur

[57] ABSTRACT

A warning panel trailer in which the warning panel, with the plurality of discrete electrical image display means, is raised to various operative positions along a column support and lowered to an inoperative position in an elongated seat on top of a platform of the trailer. The seat extends between the front and back of the trailer so that the travelling trailer stores the warning panel with an edge facing the direction of travel and the plane of the panel facing away from such direction of travel. The warning panel is lowered and raised by a winched cable which turns around a lower pulley assembly adjacent the platform of the trailer and an upper, pivotally mounted pulley assembly which rotates with the warning panel when selectively positioning the warning panel.

7 Claims, 6 Drawing Figures

FIG. 1
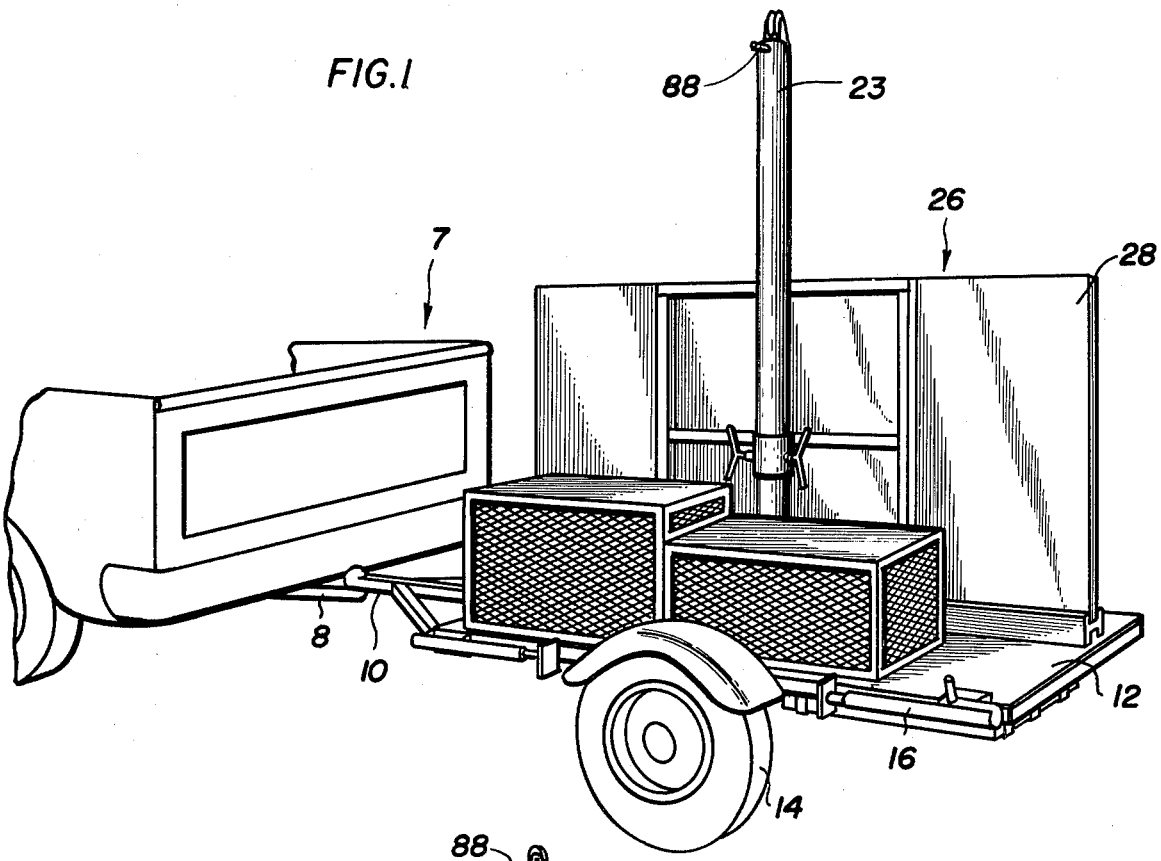
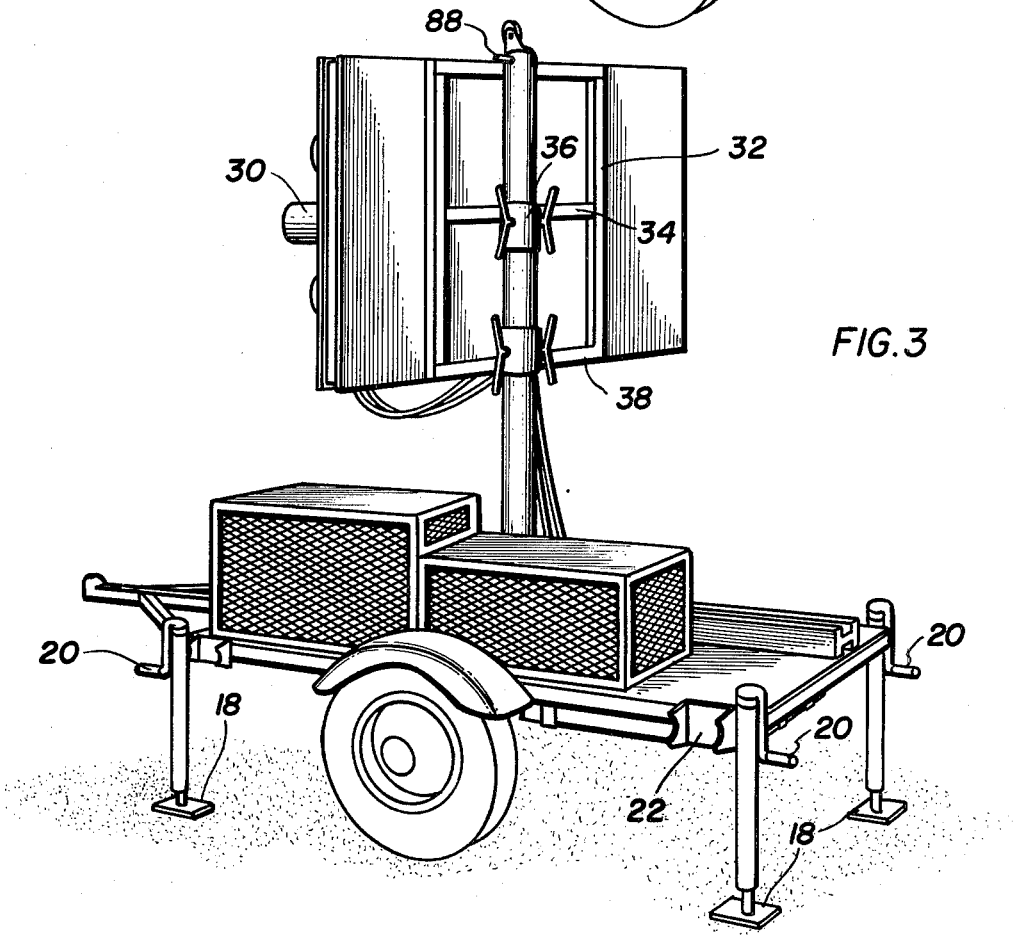
FIG. 3

FIG. 2
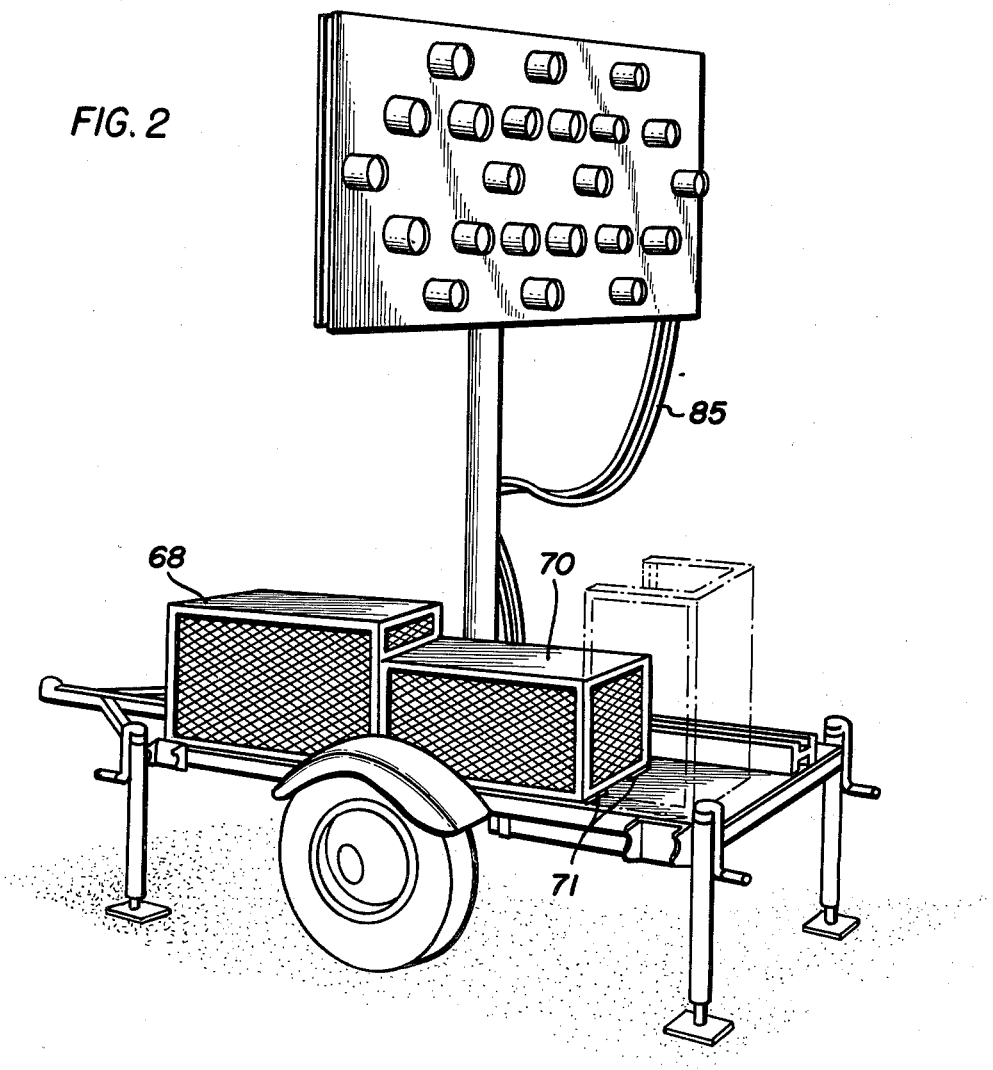
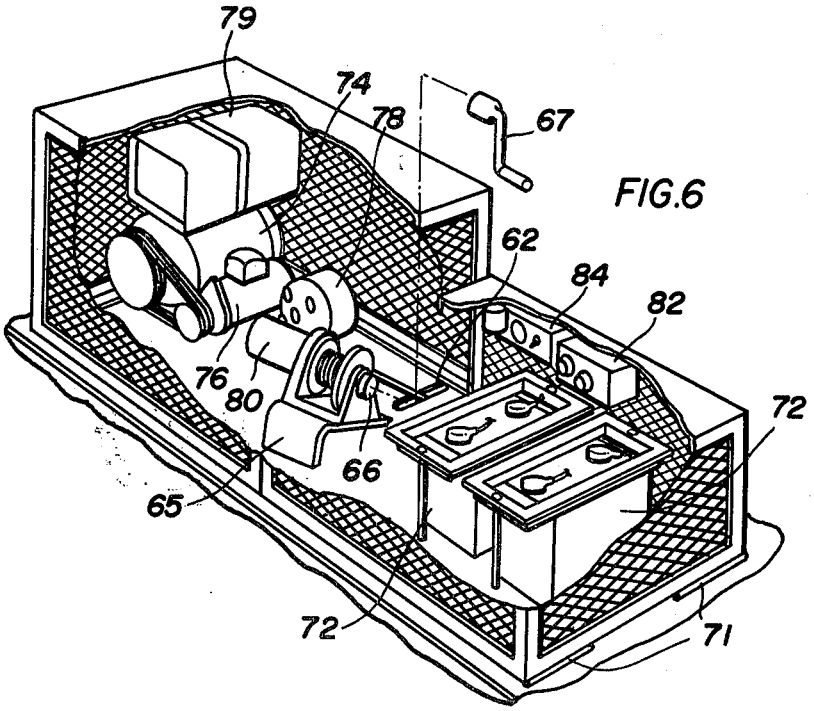
FIG.6

TRAILER WARNING PANEL ASSEMBLY

This invention relates to a trailer warning panel, and particularly relates to an assembly wherein a warning panel is mounted, displayed and stored in an improved way.

Construction sites require the presence of various safety and warning structures, and one such structure which is undergoing more frequent use is a trailer warning panel. Such a trailer generally includes a platform having wheels on the opposite sides and a forward coupler for engaging a hitch on a towing vehicle. The platform has a superstructure on which it has been known to mount a warning panel having a plurality of discrete electrical image display means. A battery is commonly provided as a voltage source on the platform of the trailer, and there is also an internal combustion engine, with engine accessories, for operating a generator or alternator to recharge the battery.

The operative warning panel displays characteristic electrical images, such as in the form of arrows directing traffic to a particular side. When inoperative, the warning panel is moved from its display position to facilitate transport when the trailer panel is towed. Such warning panel has been cranked to a flat down position on top of the superstructure to assume a travelling condition, but problems arise from wind effect on the superstructure and face down panel which take the form of swaying and the like. This presents a serious problem of control in towing or hauling the trailer on the roadway.

It is therefore an object of the present invention to provide an improved trailer warning panel assembly which provides greater versatility and utility in raising the warning panel to operative levels, displaying the panel, and lowerng the panel to inoperative or stored condition for travel.

Another object is a trailer and warning panel assembly of the type described in which the warning panel can be quickly and easily raised to selected heights for clear viewing, and further selectively positioned at the attained height level for best viewing to warn oncoming traffic.

Yet another object of the present invention is a trailer and warning panel assembly in which the warning panel may be quickly and easily lowered to an inoperative position where such panel is stored and positioned in a way best designed for travel with minimal sway and related control problems.

Still yet another object of the present invention is a trailer and warning panel assembly in which the lowering or raising of a warning panel is effected by reliable means capable of certain and quick execution; and further allowing accurate placement of the warning panel at predetermined height levels.

Yet another object of the present invention is a trailer and warning panel assembly which provides improved distribution of engine and engine accessory means below and above the platform to best utilize space and accessibility.

Such objects are now attained, together with still other objects, which will occur to practitioners from time to time, by the invention of the following disclosure which includes drawings wherein:

FIG. 1 is a perspective view of the trailer in hitched and inoperative position;

FIG. 2 is a view similar to that of FIG. 1, but showing the trailer in operative position;

FIG. 3 is a view similar to that of FIG. 2, but showing the reverse side of the warning panel with associated structures for selectively rotating the panel;

FIG. 4 is a sectional view of the pivot and locking means taken along line 4—4 of FIG. 5;

FIG. 6 is a perspective view, with portions removed, of the house engine, lifting means, and accessory items mounted on the platform of the trailer.

Figure 5:
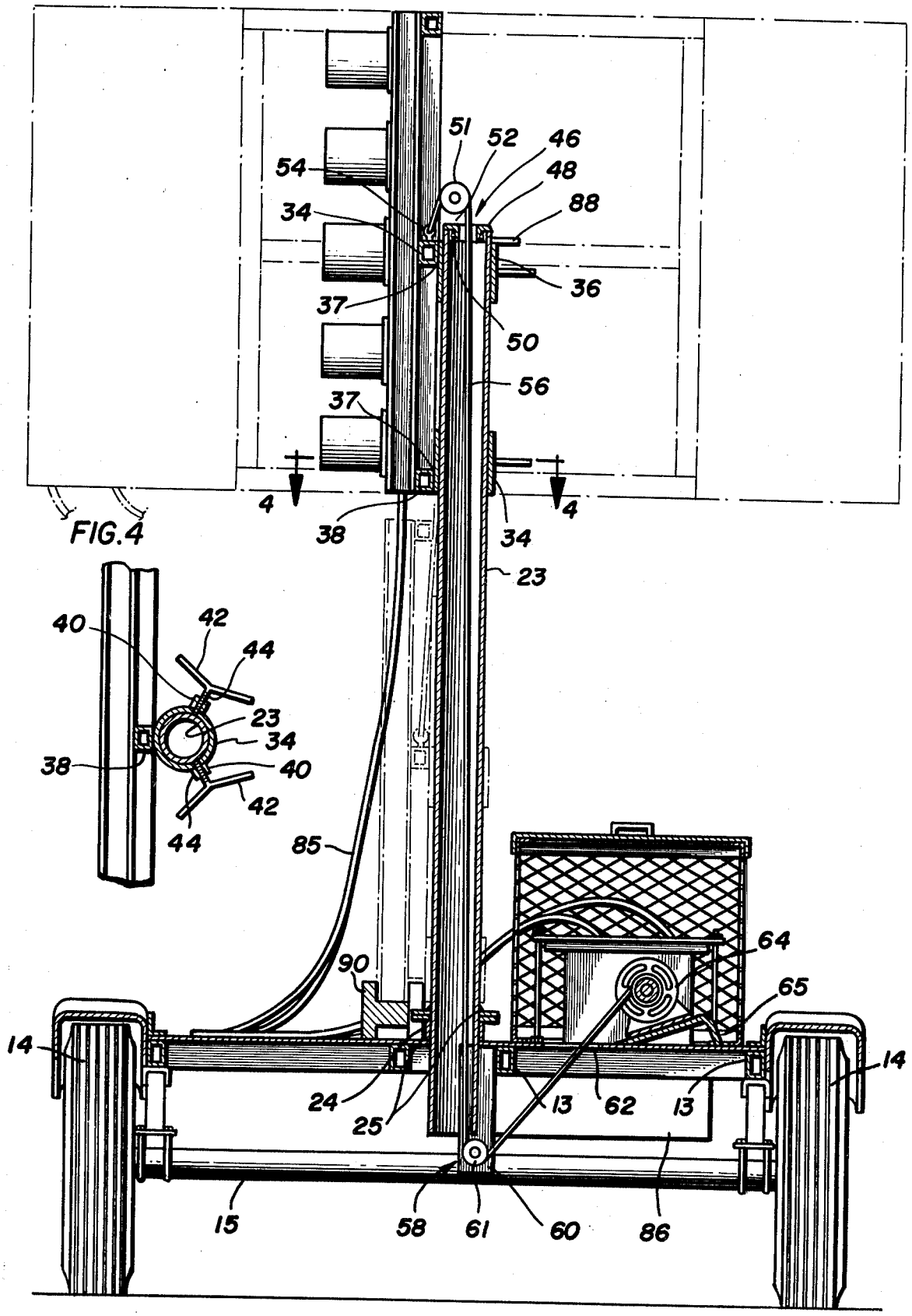
FIG. 5 is a rear elevational view of the trailer, on an enlarged scale, and partly in section.

The view of FIG. 1 shows the mobile warning panel assembly in hitched position to a towing vehicle 7, such vehicle having a hitch 8 to which is coupled hitching or hookup member 10 of the mobile warning panel assembly.

Considering in greater detail the mobile warning panel assembly, there is seen a platform member 12 which has a plurality of underlying tubular supports 13, seen in the view of FIG. 5. The platform is provided with oppositely side mounted wheels 14 on axel 15. The platform is shown as having a general rectangular configuration and to the opposite end of each long side of the platform is mounted a support and stabilizing leg 16. Such legs are shown non-operational in the view of FIG. 1, and operational in the view of FIG. 3. Each of the legs 16 has a bottom foot 18 which is extended into ground contact position by operating crank 20. The connecting gearing is not shown, but is essentially provided to extend and retract the foot element 18. Holding brackets 22 are provided at the sides of the platform 12 to hold the stabilizer legs 16 in non-operational positions.

An upright column support 23 extends from the top surface of the platform 12. The column support is shown as tubular and cylindrical. Said column support moves through annular stand 24 and extends below the platform. The column support 23 is fixed to the annular stand 24 by welds 25 which also fix the stand to the top of the platform 12.

A warning panel assembly shown generally as 26 is raised and lowered along column support 23. The warning panel assembly includes a panel member or board 28 which has a plurality of electrical image forming means 30 on the obverse side. Selective actuation of the electrical image means displays recognizable traffic warning indicia, such as a flashing arrow or the like. The reverse side of the panel has a frame structure 32 which includes an intermediate cross piece 34 having collar element 36 affixed thereto by means such as welds 37. The frame structure also includes a lower cross piece 38 which has a similar collar element, similarly affixed thereto. The collar elements are rotatably mounted to the column support 23 so that the warning panel assembly 26 may be rotated to any selected position along a full 360° rotation.

Looking now at FIG. 4, each of the collar elements 34 is shown as having circumferentially spaced lugs 40 which receive winged bolts 42, each of said bolts having a threaded shank 44 which passes through threaded bores in such lugs. The ends of the threaded shanks frictionally engage the outside surface of the column support to lock the warning panel assembly in a selectively rotated position.

The warning panel assembly is raised and lowered by means which include an upper pully assembly 46. A rotatable flanged ring is a part of such upper pulley assembly, and the rotation of such ring is facilitated by a bearing and race assembly 50. The upper pulley assembly further includes an upper roller 51 which is rotatably fixed to bracket wing 52 extending upwardly from flanged ring 48. An eye hook 54 is fixed to the intermediate cross piece 34 on the reverse side of the panel. A flexible elongated carrying member, shown as cable 56, has one end securely connected to the eye hook 54. The flexible cable turns around upper roller 51 and extends through the tubular passageway of the column support to a lower pulley assembly 58. The lower pulley assembly is shown below the platform 12, and is further shown as including an elongated plate bracket 60 mounted in a slot in the wall of the column support (not shown); and to one of the elongated tubular supports 13. A roller 61 is rotatably mounted toward the bottom of the plate bracket, and the flexible cable 56 turns around such roller upwardly through a platform opening 63 to a winch 64 mounted to the top of the platform 12.

The winch is shown mounted on an angular stand 65, and such winch has a stub shaft 66 to which handle 67 can be connected to manually operate raising and lowering of the warning panel assembly should power failure occur. The winch and other parts are grouped or caged within a housing which includes a raised housing or cage part 68 and an adjoining lowered housing or cage part 70. There is sufficient clearance between the raised and lowered housing part so that such parts can be raised and moved away to expose the caged structures. The lowered housing part 70 is shown in phantom, pivoted upwardly by hinges 71 mounted to the platform and to the lower outside edge of said caged part.

The structures within the cage parts include the foregoing winch, electrical storage batteries 72, an internal combustion engine 74, and alternator 76 operated by the engine, and an electrical starter 78. A reserve oil tank 79 is shown mounted on top of the internal combustion engine. The winch 64 is operated by an electric motor 80. The alternator charges the battery which provides the electrical power source for operating the winch and operating the electrical image means 30 on the warning panel assembly through control boards 82, 84. Electrical cables are selectively indicated at 75, and such cables extend between the warning panel and the electrical power supply and control boards.

In operation, there is obtained a mobile warning system in which a warning panel is mounted on a trailer, such warning panel shown as a four-sided polygon. The warning panel is raised and lowered by the sliding engagement of the pivot means or collars 34, 36 which are fixed to the reverse side of the warning panel. Not only do the pivot means allow the panel to be raised and lowered, but to be selectively rotated and locked in a selected rotated position by locking means such as the winged bolt 42.

A gas tank 86 is preferably mounted on the underside of the platform 12 to conserve space on the top surface for the engine, engine accessories, engine controls, battery power source, and the winch. Likewise, such space is utilized for the column support and placement of the electrical cables 85.

The warning panel assembly is limited in its upward travel by providing a stop element shown as bolt 88 fixed adjacent the top of the column support 23. The top continuous edge of the collar 36 abuts against such stop element and limits the upward movement of the warning panel under urgings of the winched cable. A slip clutch allows the winch motor to operate freely in such a situation.

The limit of lower travel of the warning panel is an elongated seat 90 which has a channel configuration to receive the bottom side or edge of the polygonal warning panel. The seat 90 extends between the front and back of the trailer platform so that the travelling trailer stores the warning panel when inoperative with a side edge facing the direction of travel and the plane of the panel facing away from such direction of travel. This reduces wind resistance which would hamper movement of the trailer by causing swaying and the like. The panel is safely raised to an operative position by winching the cable, and such panel is safely held in the operative position by the strong cable which can be, say, about a 4,000 lb. cable. FIG. 5 illustrates the warning panel rotated to position for lowering to the seat 90, the display position of the panel being indicated in phantom, as well as is the storage position in the seat. The long axis of the seat is shown parallel to the sides of the platform so the plane of the stored panel is turned away from the direction of trailer travel.

The claims of the invention are now presented and the terms of such claims may be further understood by reference to the language of the preceding specification and the views of the drawings.

What is claimed is:

1. A trailer warning panel having a platform with opposite side mounted wheels in a warning panel with a plurality of discreet electrical image display means, including a support column extending upwardly from said platform, spaced rotary means mounted on said column support, one being an upper rotary means and the other being a lower rotary means adjacent a platform, said upper rotary means being pivotally mounted to said support column, an elongated, flexible carrying member positioned adjacent said support column, said flexible carrying member having one end connected to the warning panel, means to move said flexible carrying member in opposite directions around said rotary means, said moving means being further adapted to selectively stop said flexible carrying member such that the warning panel connected to said flexible carrying member may be raised and lowered to any preselected position, pivot means rotatably mounting said warning panel to said support column, locking means associated with said pivot means for permitting the locking engagement of said pivot means in any preselected rotated position relative to said support column, said pivot means and locking means thereby permitting the flexible carrying member and warning panel connected thereto to be raised and lowered along the length of said support column, and to also permit the selective rotation of the warning panel such that the warning panel may be raised to any desired height and rotated to any desired angle and lockingly engaged in position, and means to hold the warning panel on the platform, said holding means comprising an elongated seat mounted on the platform, the long axis of said seat being substantially parallel to the opposite sides of the trailer whereby the plane of the warning panel when stored in the elongated seat is turned in the direction of trailer travel.

2. A trailer warning panel having a platform with opposite side mounted wheels and a polygonal warning panel with a plurality of discrete electrical image display means, including a support column extending upwardly from said platform, spaced pulley assemblies on said column support, one being an upper pivotally mounted pulley assembly and the other being a lower pulley assembly mounted adjacent the platform, said upper pulley assembly being pivotally mounted to said support column, pivot means fixed to the back of the warning panel and rotatably mounted to said column support, locking means associated with said pivot means for permitting the locking engagement of said pivot means in any preselected rotated position relative to said column support, a cable turnable around said spaced pulley assemblies, one end of said cable being fixed to the back of said warning panel, said pivot means and locking means thereby permitting said cable and warning panel connected thereto to be raised and lowered along the length of said column support, and to also permit the selective rotation of the warning panel such that the warning panel may be raised to any desired height and rotated to any desired angle and lockingly engaged in position, a winch on said platform, said cable being extended and shortened by said winch to raise and lower the warning panel, and an elongated warning panel seat on the platform, the long axis of said seat being substantially parallel to the sides of the platform whereby the plane of the warning panel when stored in the elongated seat is turned in the direction of trailer travel.

3. A trailer warning panel which includes the features of claim 2 wherein said support column is a tubular member, and said cable moves in the passageway of said tubular member.

4. A trailer warning panel which includes the features of claim 5 wherein said tubular member is of cylindrical configuration, said warning panel pivot means is a collar element slidably mounted around said cylindrical tubular member, and said locking means is a threaded bolt mounted in the threaded bore of said collar element, said bolt contacting the cylindrical tube member in locking relationship.

5. A trailer warning panel having the features of claim 4, which further includes a stop element fixed to the tubular support column adjacent the top thereof, said stop element engagable by the top of said collar element to limit upward movement of said warning panel.

6. A trailer warning panel which includes the features of claim 4 wherein said cylindrical member extends below the platform, said lower pulley assembly is mounted to the cylindrical member below the platform, and said cable passes through an opening in the platform from the winch to the lower pulley assembly.

7. A trailer warning panel having the features of claim 6, wherein an openable housing is on top of said platform, said housing enclosing the winch, an internal combustion engine, engine accessories, engine controls and a battery power source, a fuel tank mounted below the platform, and wherein said elongated warning panel seat is a channel member secured to the top of the platform and extending substantially between the front and back of the trailer.

* * * * *